US009296520B2

(12) United States Patent
Wakatabi

(10) Patent No.: US 9,296,520 B2
(45) Date of Patent: Mar. 29, 2016

(54) ENVELOPE SHEET

(71) Applicant: RISO KAGAKU CORPORATION, Tokyo (JP)

(72) Inventor: Tadayuki Wakatabi, Ibaraki-ken (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 13/767,496

(22) Filed: Feb. 14, 2013

(65) Prior Publication Data

US 2013/0206824 A1 Aug. 15, 2013

(30) Foreign Application Priority Data

Feb. 15, 2012 (JP) ..... 2012-030297

(51) Int. Cl.
*B65D 27/16* (2006.01)
*B43M 5/04* (2006.01)

(52) U.S. Cl.
CPC . *B65D 27/16* (2013.01); *B43M 5/04* (2013.01)

(58) Field of Classification Search
CPC ..... B42D 15/08; B42D 5/025; B65D 27/00; B65D 27/16; B43M 3/04; B43M 5/04
USPC ..... 229/75, 76, 80
See application file for complete search history.

(56) References Cited

U.S. PATENT DOCUMENTS 22,405 A * 12/1858 Arnold ..... 229/75
286,881 A * 10/1883 Weaver ..... 229/75
291,079 A * 1/1884 Post ..... 229/75
442,842 A * 12/1890 West ..... 229/75
653,599 A * 7/1900 West ..... 229/76
821,723 A * 5/1906 Lord ..... 229/92.3
913,473 A * 2/1909 Draemel ..... 229/75
2,128,275 A * 8/1938 Vogel ..... 229/92.7
2,213,729 A * 9/1940 Anderson ..... 53/570
2,408,626 A * 10/1946 Green ..... 283/101

(Continued)

FOREIGN PATENT DOCUMENTS

CN 2380390 Y 5/2000
CN 1411413 A 4/2003

(Continued)

OTHER PUBLICATIONS

Search report issued on Jun. 14, 2013 in the counterpart European application No. 13155396.8.

(Continued)

*Primary Examiner* — J. Gregory Pickett
*Assistant Examiner* — Peter Helvey
(74) *Attorney, Agent, or Firm* — Greenblum & Bernstein, P.L.C.

(57) ABSTRACT

Another coating part is formed along a sheet short side direction, on a region which is a part of an envelope outer side of a third component sheet and which contacts a flap by folding along a second folding line. A first cutout part and a second cutout part which respectively extend in an extension direction of a first coating part and a second coating part, are respectively formed on both side fringes in the sheet short side direction in the third component sheet. The minimum width of each of the first cutout part and the second cutout part in the sheet short side direction is set longer than a length from the side fringe of the envelope sheet in the sheet short side direction to the inner side fringe of each of the first coating part and the second coating part.

7 Claims, 8 Drawing Sheets

(56) References Cited

U.S. PATENT DOCUMENTS

| | | | | | |
|---|---|---|---|---|---|
| 2,773,638 | A | * | 12/1956 | Krohn | 229/92 |
| 3,339,828 | A | * | 9/1967 | Hiersteiner | 229/72 |
| 3,523,638 | A | * | 8/1970 | Moonan | 229/92.1 |
| 3,908,892 | A | | 9/1975 | Pelzer | |
| 3,995,808 | A | | 12/1976 | Kehoe | |
| 3,998,138 | A | * | 12/1976 | Walters | 493/233 |
| 4,644,144 | A | * | 2/1987 | Chandek et al. | 235/487 |
| 4,951,864 | A | | 8/1990 | Dicker | |
| 5,048,748 | A | * | 9/1991 | Martin et al. | 229/92.1 |
| 5,114,067 | A | | 5/1992 | Martin et al. | |
| 5,650,209 | A | * | 7/1997 | Ramsburg et al. | 428/43 |
| 5,687,903 | A | * | 11/1997 | Akridge et al. | 229/75 |
| 6,131,802 | A | * | 10/2000 | Lombardo | 229/92.1 |
| 6,432,232 | B1 | * | 8/2002 | Martin | 156/64 |
| 2010/0001049 | A1 | * | 1/2010 | Morton | 229/75 |
| 2012/0260605 | A1 | * | 10/2012 | Nozawa et al. | 53/55 |

FOREIGN PATENT DOCUMENTS

| | | | |
|---|---|---|---|
| CN | 201427713 | Y | 3/2010 |
| CN | 201494717 | U | 6/2010 |
| GB | 2442946 | A | 4/2008 |
| JP | 2000-343892 | A | 12/2000 |
| JP | 2006-035742 | A | 2/2006 |

OTHER PUBLICATIONS

Official Action issued on Sep. 3, 2014 in the counterpart Chinese application.

* cited by examiner

ENVELOPE SHEET

CROSS REFERENCE TO RELATED APPLICATION

This application claims benefit of priority under 35 U.S.C. §119 to Japanese Patent Application No. 2012-030297 filed on Feb. 15, 2012, the entire contents of which are incorporated by reference herein.

BACKGROUND OF THE INVENTION

1. Field of the Invention

The present invention relates to an envelope sheet used for manufacturing an envelope.

2. Description of the Related Art

In recent years, along with expanding use of envelopes for direct mails or the like, various types of envelope sheets used when manufacturing envelopes with an automatic envelope manufacturing system have been developed (Patent Document 1: Japanese Patent Application Laid-Open Publication No. 2000-343892). The configuration of an envelope sheet according to prior art is as follows.

The envelope sheet according to prior art has a first rectangular component sheet. A second rectangular component sheet is consecutively connected to the first component sheet along an envelope unfolding direction (sheet long side direction) via a first folding line. A third rectangular component sheet is consecutively connected to the second component sheet along the envelope unfolding direction via a second folding line. In other words, three rectangular component sheets are consecutively connected along the envelope unfolding direction via two folding lines. Here, the first component sheet will serve as the front sheet or the back sheet of the envelope, and the second component sheet will serve as the back sheet or the front sheet of the envelope. The first component sheet has an openable and closable flap on one end side in the envelope unfolding direction.

Coating parts coated with pressure-sensitive adhesive are respectively formed along the envelope unfolding direction, on both side fringes in a direction (sheet short side direction) orthogonal to the envelope unfolding direction in the envelope inner side of each component sheet. In addition, coating parts coated with pressure-sensitive adhesive are respectively formed along the envelope unfolding direction, on both side fringes in the sheet short side direction in the envelope outer side of the third component sheet. Here, a degree of sealing of the envelope can be sufficiently secured by bonding the coating parts of the envelope inner side of the first component sheet to the coating parts of the envelope outer side of the third component sheet, in a state where the coating parts of the envelope inner side of the second component sheet are bonded to the coating parts of the envelope inner side of the third component sheet.

Note that although not clearly described in Patent Document 1, another coating part coated with adhesive for closing the flap is usually formed on the envelope inner side of the flap along the sheet short side direction.

The automatic envelope manufacturing system uses a line head inkjet printing device which can achieve variable printing and high-speed printing. In the line head inkjet printing device, as shown in FIG. 1, the distance (interval) between an endless belt (exemplary conveyance member) which conveys envelope sheets and the inkjet head is about 1 mm, which is very small. Typically, an envelope sheet is printed in a state where the envelope sheet is absorbed toward the endless belt by using, for example, air pressure caused by driving a fan (exemplary absorption member).

The periphery of another coating part of the first component sheet is deformed due to coating of adhesive. If the periphery of another coating part of the first component sheet is largely deformed, absorbing the envelope sheet toward the endless belt cannot correct deformation of the periphery of another coating part of the first component sheet. Thereby, passage of envelope sheets between the inkjet head and the endless belt becomes difficult, as shown by the phantom line in FIG. 1, and a problem may arise such as occurrence of paper jam. Note that, FIG. 1 is a schematic diagram showing a printer in the line head inkjet printing device. In the drawing, reference numerals of respective components of the printer to be described below are provided.

SUMMARY OF THE INVENTION

It is an object of the present invention to provide an envelope sheet with a novel configuration which can sufficiently suppress occurrence of paper jam.

According to a first aspect of the present invention, there is provided an envelope sheet used when manufacturing an envelope, comprising: n (where n is an integer of three or more) rectangular component sheets; and (n−1) folding lines for consecutively connecting the n component sheets along an envelope unfolding direction, wherein each folding line consecutively connects adjacent component sheets, wherein a first component sheet serves as a front sheet or a back sheet of the envelope, a second component sheet serves as a back sheet or a front sheet of the envelope, the first component sheet has an openable and closable flap on one end side in the envelope unfolding direction, a first coating part and a second coating part coated with pressure-sensitive adhesive are respectively formed along the envelope unfolding direction, on both side fringes of an envelope inner side of the first component sheet to a third component sheet in an orthogonal direction orthogonal to the envelope unfolding direction, and another coating part coated with another adhesive for closing the flap is formed along the orthogonal direction, on a region which is a part of an envelope outer side of the third component sheet and which contacts the flap by folding along the second folding line.

Here, if n is an integer of four or more, the length (width) of the fourth and subsequent component sheets in the orthogonal direction is set not more than the length of the third folding line in the orthogonal direction.

According to a second aspect of the present invention, in addition to the first aspect, a first cutout part and a second cutout part which respectively extend in an extension direction of the first coating part and the second coating part, are respectively formed on both side fringes in the orthogonal direction in the third component sheet.

According to a third aspect of the present invention, in addition to the second aspect, a minimum width of each of the first cutout part and the second cutout part in the orthogonal direction is set longer than a length from a side fringe of the third component sheet in the orthogonal direction to an inner side edge of each of the first coating part and the second coating part.

According to a fourth aspect of the present invention, in addition to the third aspect, the first cutout part and the second cutout part of the third component sheet are asymmetric with respect to a centerline in the orthogonal direction.

According to a fifth aspect of the present invention, in addition to the first aspect, a first chamfer and a second chamfer are respectively formed on tips of both side fringes in the orthogonal direction in the first component sheet.

According to the first aspect, the another coating part is formed along the orthogonal direction, on a region which is a part of the envelope outer side of the third component sheet and which contacts the flap by folding along the second folding line. Therefore, the another coating part of the third component sheet can be sufficiently spaced apart from the end of the envelope sheet in the envelope unfolding direction so that an absorption area of the periphery of the another coating part of the third component sheet can be sufficiently secured. Accordingly, even if deformation occurs in the periphery of the another coating part of the third component sheet due to coating of adhesive, deformation of the periphery of the another coating part in the third component sheet can be corrected by absorbing the envelope sheet toward the conveyance member in the inkjet printing device when printing on the envelope sheet by a line head inkjet printing device. As a result, occurrence of paper jam can be sufficiently suppressed by allowing stable passage of envelope sheets between the inkjet head of the inkjet printing device and the conveyance member.

According to the second aspect, the first cutout part and the second cutout part which respectively extend in the extension direction of the first coating part and the second coating part, are respectively formed on both side fringes of the third component sheet in the orthogonal direction. Therefore, rigidity of the third component sheet can be reduced. Accordingly, deformation of the periphery of the another coating part of the third component sheet can be easily corrected by absorbing the envelope sheet toward the conveyance member. As a result, occurrence of paper jam can be suppressed more sufficiently.

According to the third aspect, the minimum width of each of the first cutout part and the second cutout part in the orthogonal direction is set longer than the length from the side fringe of the third component sheet in the orthogonal direction to the inner edge of each of the first coating part and the second coating part. Therefore, a degree of sealing of the envelope can be sufficiently secured by bonding the first coating part and the second coating part of the envelope inner side of the first component sheet to the first coating part and the second coating part of the second component sheet via the first cutout part and the second cutout part of the third component sheet, in a state where the first coating part and the second coating part of the envelope inner side of the second component sheet are bonded to the first coating part and the second coating part of the envelope inner side of the third component sheet. In other words, a degree of sealing of the envelope can be sufficiently secured by simply forming the first coating part and the second coating part on the envelope inner side of the first to third component sheets, without forming a coating part where pressure-sensitive adhesive is pasted, on the envelope outer side of any of the component sheets. Therefore, the number of manufacturing processes of the envelope sheet can be reduced so as to reduce the manufacturing cost of envelope sheet. In addition, bonding of envelope sheets can be prevented by simply overlaying a large number of envelope sheets so that either the inner or outer side of the envelope faces upward, thereby increasing the ease of handling of envelope sheets.

According to the fourth aspect, the first cutout part and the second cutout part are asymmetric with respect to the centerline in the orthogonal direction. Therefore, it becomes easy to extract, from a large number of envelope sheets, those having reversed orientation of the inner and outer sides, by simply overlaying the large number of envelope sheets. As a result, ease of handling of envelope sheets can be further increased.

According to the fifth aspect, the first chamfer and the second chamfer are respectively formed on the tips of both side fringes in the orthogonal direction in the first component sheet. Therefore, it is possible to reduce warping deformation that may appear in the vicinity of the tips of both side fringes in the orthogonal direction in the first component sheet due to coating of pressure-sensitive adhesive. Accordingly, passage of envelope sheet between the inkjet head and the conveyance member can be performed more stably, whereby occurrence of paper jam can be suppressed more sufficiently.

DESCRIPTION OF THE EMBODIMENTS

An automatic envelope manufacturing system according to a first and a second embodiment of the present invention, an envelope sheet according to the first embodiment of the present invention, and an envelope sheet according to the second embodiment of the present invention will be described below in sequence, referring to FIGS. 2 to 8C.

(Automatic Envelope Manufacturing System According to the First and Second Embodiments of the Present Invention)

Figure 5:
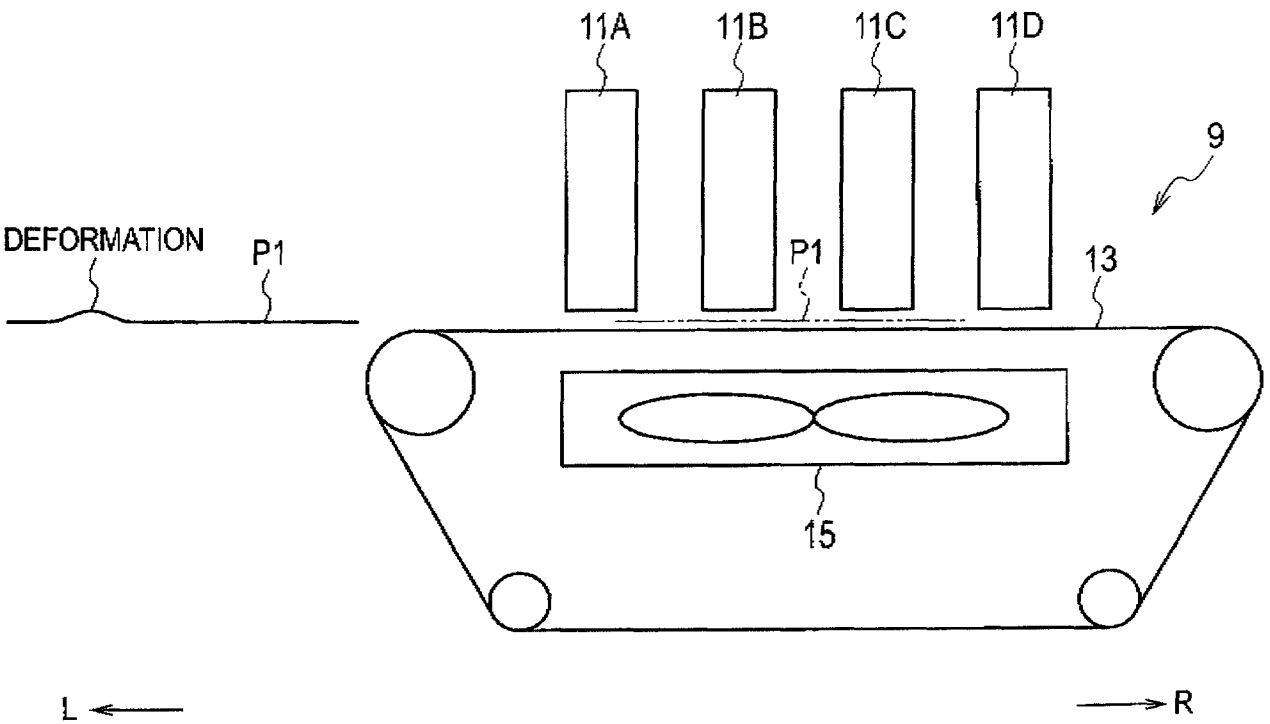
FIG. 5 is a schematic diagram showing a printer in a line head inkjet printing device according to the first and second embodiments of the present invention.

An automatic envelope manufacturing system according to the first and second embodiments of the present invention will be described, referring to FIGS. 5 and 6. Note that, in the following description, the term "downstream" refers to downstream from the viewpoint of the conveyance direction CD of an envelope sheet P1 and content sheets P2, or the like. The term "upstream" refers to upstream from the viewpoint of the conveyance direction CD of the envelope sheet P1 and the content sheets P2, or the like. In addition, "L" and "R" in FIGS. 5 and 6 refer to the left and right directions, respectively.

Figure 6:
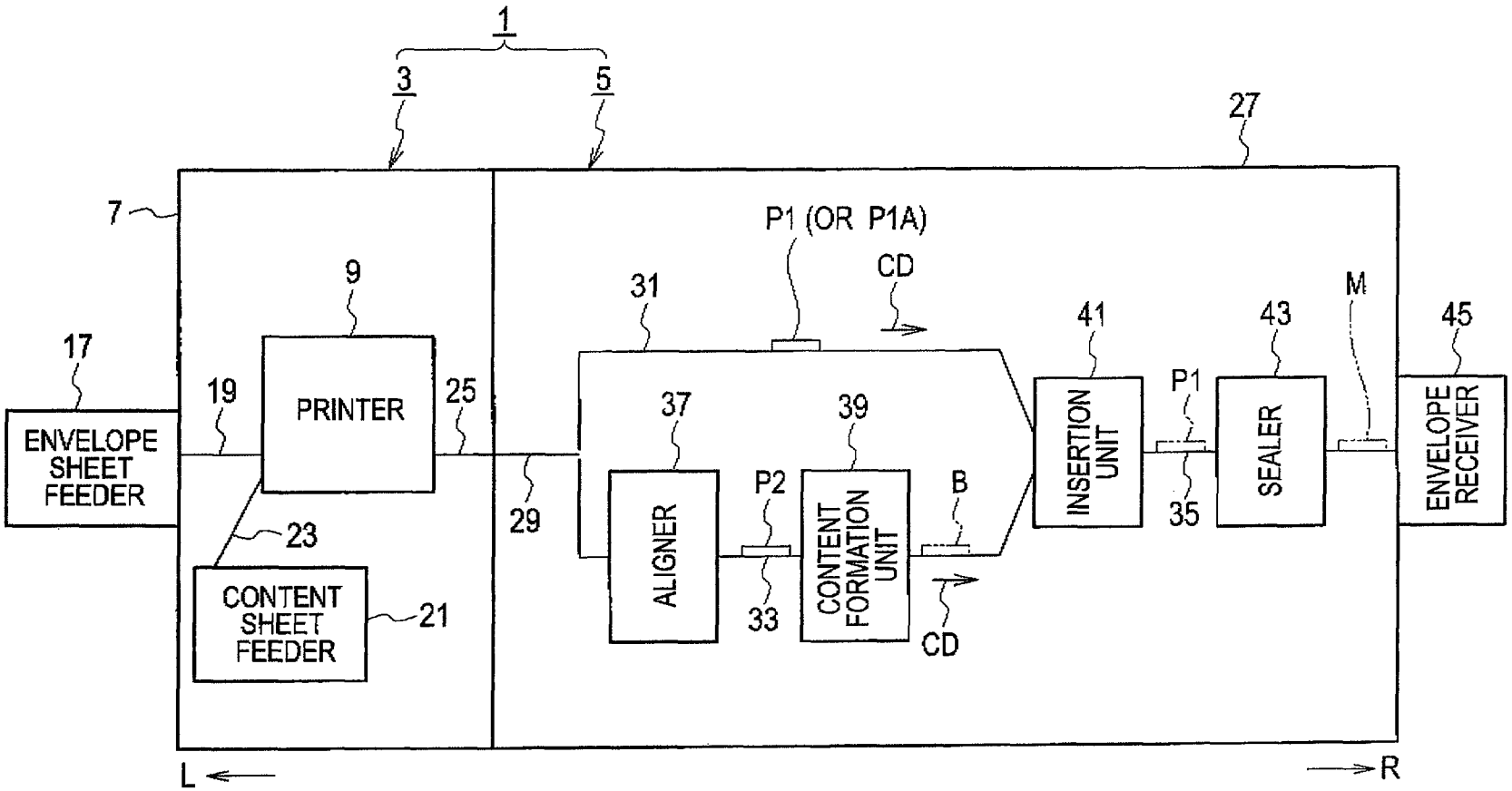
FIG. 6 is a conceptual diagram of an automatic envelope manufacturing system according to the first and second embodiments of the present invention.
Figure 7:
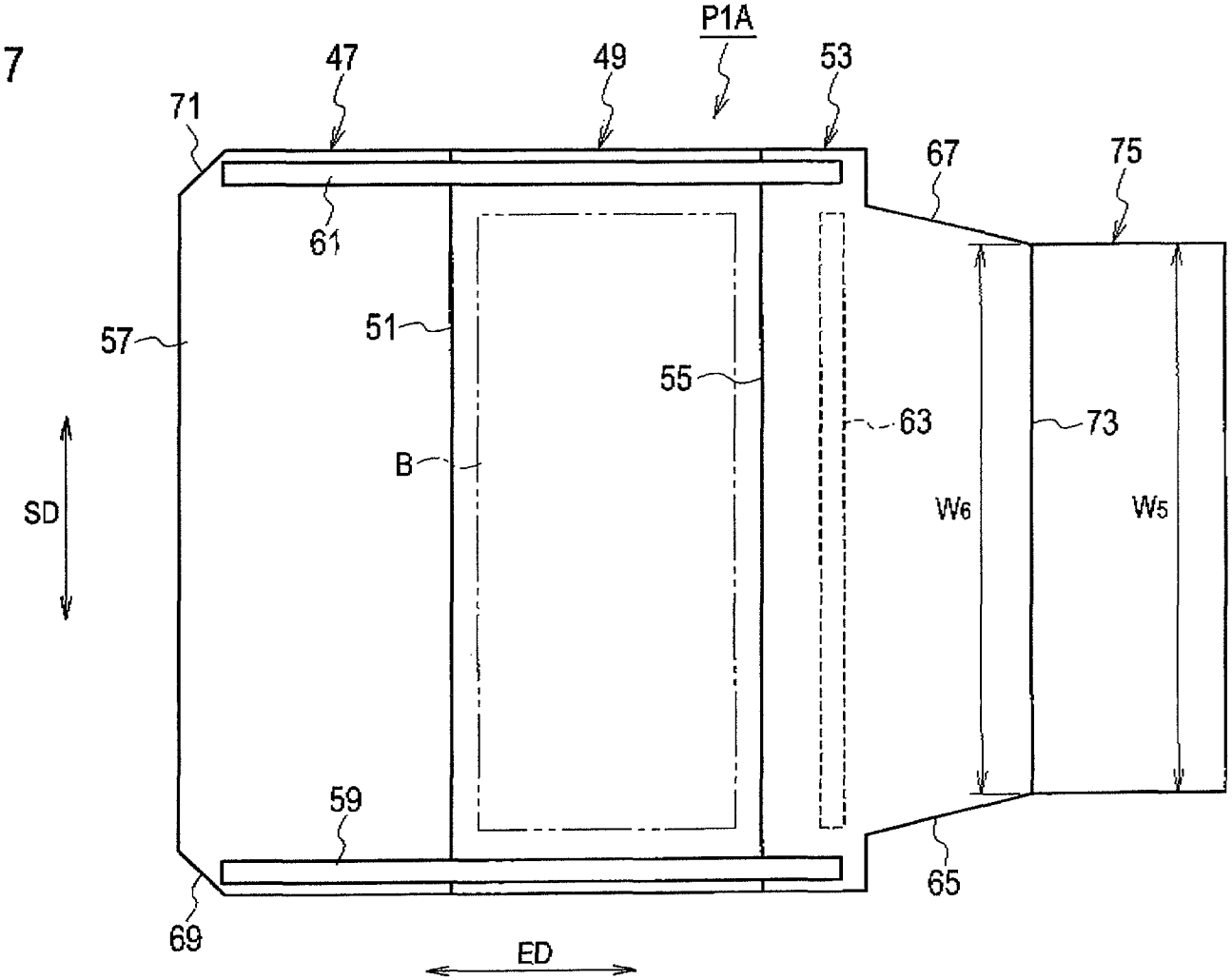
FIG. 7 is a view of the envelope sheet according to the second embodiment of the present invention seen from the envelope inner side.
Figure 8A:
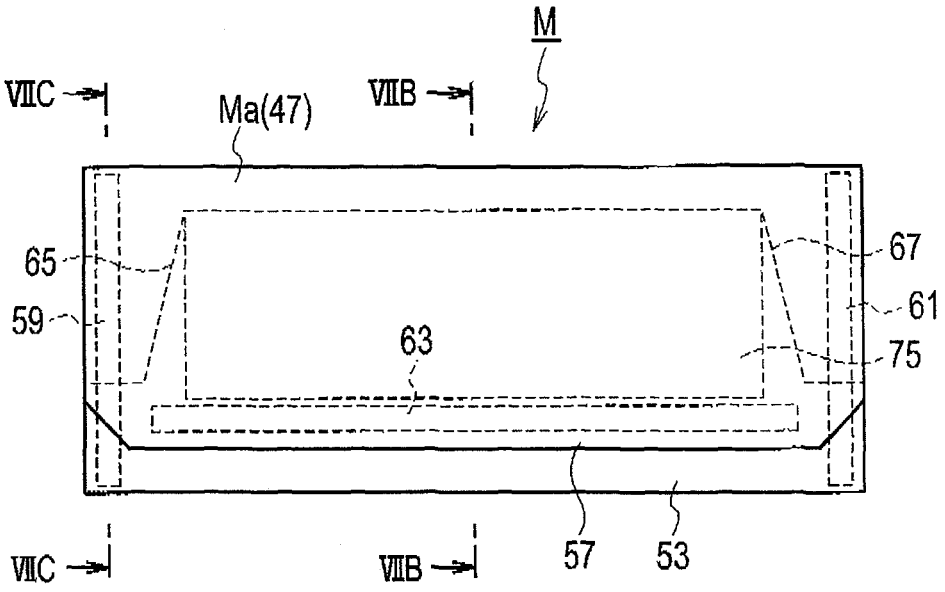
FIG. 8A is a view of the envelope according to the second embodiment of the present invention seen from the back sheet side.
Figure 8B:
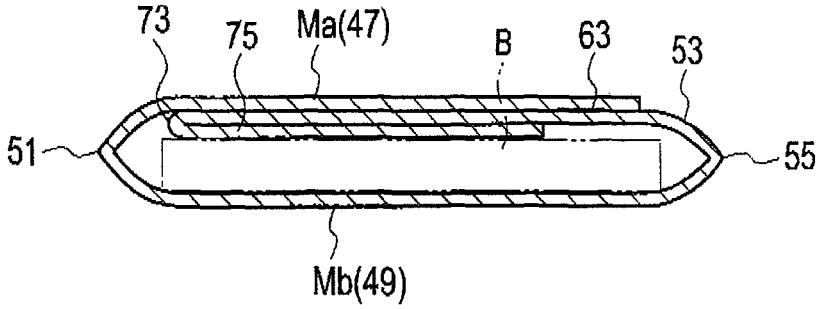
FIG. 8B is a cross-sectional view taken along line VIIB to VIIB in FIG. 8A.
Figure 8C:
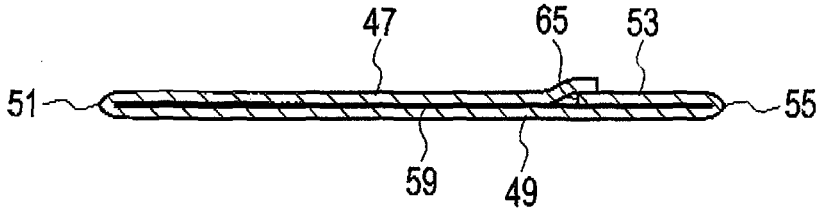
FIG. 8C is a cross-sectional view taken along line VIIC to VIIC in FIG. 8A.

As shown in FIG. 6, the automatic envelope manufacturing system 1 performs printing on an envelope sheet P1 (or P1A) and a plurality of content sheets P2, forms a content B from the plurality of printed content sheets P2, and manufactures, from the printed envelope sheet P1, an envelope M having the content B enclosed therein. In other words, the automatic envelope manufacturing system 1 has a line head inkjet printing device 3 which performs printing on the envelope sheet P1 and the plurality of content sheets P2, and an insertion and sealing device 5 provided at a position adjacent to the inkjet printing device 3. Here, the insertion and sealing device 5 forms the content B from the plurality of printed content sheets P2, and seals the folded and printed envelope sheet P1 with the content B enclosed therein.

The inkjet printing device 3 in the automatic envelope manufacturing system 1 has a printing device housing 7 (referred to as device housing 7 as appropriate, in the following). The device housing 7 has provided therein a printer 9 which performs printing on the envelope sheet P1 and the content sheets P2 based on envelope print data and content print data. Specifically, as shown in FIG. 5, the device housing 7 has provided therein a plurality of line inkjet heads 11A, 11B, 11C and 11D which eject black, cyan, magenta and yellow inks, respectively. An endless belt 13 which conveys, as a conveyance member, the envelope sheet. P1 and the content sheets P2 rightward is provided under the inkjet heads 11A, 11B, 11C and 11D in the device housing 7. The endless belt 13 has a plurality of through-holes (not shown) formed thereon. A fan (exemplary absorption member) 15 which absorbs the envelope sheet P1 and the content sheets P2 using air pressure toward the endless belt 13 is provided inside the endless belt 13 in the device housing 7. Note that, instead of using the fan 15 as a component of the printer 9, another absorption member which absorbs the envelope sheet P1 and the content sheets P2 toward the endless belt 13 using static electricity may be used.

As shown in FIG. 6, an envelope sheet feeder 17 which feeds the envelope sheet P1 toward the printer 9 is provided at the side of the device housing 7. An envelope sheet feeding path 19 for conveying the envelope sheet P1 toward the printer 9 is provided between the envelope sheet feeder 17 and the printer 9 in the device housing 7. A content sheet feeder 21 which feeds the plurality of content sheets P2 sequentially toward the printer 9 is provided under the printer 9 in the device housing 7. A content sheet feeding path 23 for conveying the content sheets P2 toward the printer 9 is provided between the content sheet feeder 21 and the printer 9 in the device housing 7. A communication path 25 for conveying the printed envelope sheet P1 and the printed content sheets P2 which have been fed out from the printer 9, toward the insertion and sealing device 5 (rightward) is provided at a right part in the device housing 7.

The insertion and sealing device 5 in the automatic envelope manufacturing system 1 has an insertion and sealing device housing 27 (referred to as device housing 27 as appropriate, in the following). The device housing 27 has provided therein an introduction conveyance path 29 for introducing and conveying the printed envelope sheet P1 and the printed content sheets P2 which have been fed out from the communication path 25 (the inkjet printing device 3). The device housing 27 has provided therein a first insertion and sealing conveyance path 31 for conveying the printed envelope sheet P1. The upstream end (base end) of the first insertion and sealing conveyance path 31 can be connected to or blocked from the downstream end (tip) of the introduction conveyance path 29 by the operation of an insertion and sealing flapper (not shown). A second insertion and sealing conveyance path 33 for conveying the printed content sheets P2 or the like (including the content B) is provided under the first insertion and sealing conveyance path 31 in the device housing 27. The upstream end (base end) of the second insertion and sealing conveyance path 33 can be connected to or blocked from the downstream end of the introduction conveyance path 29 by the operation of the insertion and sealing flapper. The downstream end of the first insertion and sealing conveyance path 31 and the downstream end of the second insertion and sealing conveyance path 33 join together. The downstream side (exit side) of the junction of the first insertion and sealing conveyance path 31 and the second insertion and sealing conveyance path 33 in the device housing 27 has provided therein a third insertion and sealing conveyance path 35 for conveying the envelope M or the like (including the envelope sheet P1 folded so as to seal the content B) with the content B sealed therein.

An aligner 37 which collects and aligns the content sheets P2 is provided in the middle of the second insertion and sealing conveyance path 33 in the device housing 27. A content formation unit 39 is provided downstream (exit side) of the aligner 37 in the middle of the second insertion and sealing conveyance path 33 in the device housing 27. The content formation unit 39 folds the aligned content sheets P2 which have been fed out from the aligner 37 to form the content B. The content formation unit 39 has a plurality of content formation folding rollers (not shown).

An insertion unit 41 is provided at the junction of the first insertion and sealing conveyance path 31 and the second insertion and sealing conveyance path 33 in the device housing 27. The insertion unit 41 inserts the content B which has been fed out from the content formation unit 39 into the envelope sheet P1 while folding the printed envelope sheet P1. The insertion unit 41 has a plurality of insertion folding rollers (not shown) and a water supplier capable of supplying water (not shown).

A sealer 43 is provided in the middle of the third insertion and sealing conveyance path 35 in the device housing 27. The sealer 43 seals the envelope sheet P1 which has been fed out from the insertion unit 41 and in a folded state. The sealer 43 has a plurality of sealing rollers (not shown). An envelope receiver 45 is provided at the side of the device housing 27. The envelope receiver 45 receives the envelope M which has been fed out from the sealer 43.

(First Embodiment)

An envelope sheet according to the first embodiment of the present invention will be described, referring to FIGS. 2 to 5.

As shown in FIGS. 2 and 3A to 3C, the envelope sheet P1 is used when manufacturing the envelope M with the content B enclosed therein by the automatic envelope manufacturing system 1 described above (see FIG. 5). The envelope sheet P1 has a first rectangular component sheet (first component sheet) 47. To the first component sheet 47, a second rectangular component sheet (second component sheet) 49 is consecutively connected along the envelope unfolding direction (sheet long side direction) ED via the first folding line 51. To the second component sheet 49, a third rectangular component sheet (third component sheet) 53 is consecutively connected along the envelope unfolding direction ED via the second folding line 55. In other words, the three component sheets 47, 49 and 53 are consecutively connected along the envelope unfolding direction ED via the two folding lines 51 and 55.

Here, the first component sheet 47 serves as the back sheet Ma of the envelope M. The second component sheet 49 serves as the front sheet Mb of the envelope M. The length of the second component sheet 49 in the envelope unfolding direction ED is set not less than the length of the first component sheet 47 in the envelope unfolding direction ED. The third component sheet 53 holds the content B in cooperation with the second component sheet 49 so as to sandwich it therebetween. The length of the third component sheet 53 in the envelope unfolding direction ED is set not more than the length of the second component sheet 49 in the envelope unfolding direction ED. The first component sheet 47 has an openable and closable flap 57 on one end side in the envelope unfolding direction ED. On the envelope inner and outer sides of each of the component sheets 47, 49 and 53, documents, graphics, or the like are printed by the inkjet printer 9. The envelope sheet P1 is folded along the first folding line 51 and the second folding line 55 by a plurality of insertion and folding rollers in the insertion unit 41. Note that, instead of the first component sheet 47 serving as the back sheet Ma of the envelope M and the second component sheet 49 serving as the front sheet Mb of the envelope M, the first component sheet 47 may serve as the front sheet Mb of the envelope M and the second component sheet 49 may serve as the back sheet Ma of the envelope M.

A first and a second coating part 59 and 61 coated with pressure-sensitive adhesive (pressure paste) are continuously formed along the envelope unfolding direction ED respectively, on both side fringes in a direction SD (sheet short side direction, orthogonal direction) orthogonal to the envelope unfolding direction in the envelope inner side of each of the component sheets 47, 49 and 53. Note that, each of the first and second coating parts 59 and 61 may be discontinuous as long as each of them is formed along the envelope unfolding direction ED.

Another coating part 63 coated with water paste (water-soluble adhesive: exemplary adhesive) for closing the flap 57 is formed along the sheet short side direction SD, on a region which is a part of the envelope outer side of the third component sheet 53 and which contacts the flap 57 by folding along the second folding line 55. The another coating part 63 is sandwiched between the tips of the first and second coating parts 59 and 61. Here, the water paste, to which water is supplied by a feeder during folding of the envelope sheet P1 by the insertion unit 41, exerts adhesive force with a lower pressure force than pressure-sensitive adhesive.

A first and a second cutout part 65 and 67 extending in the extension direction of the first and second coating parts 59 and 61 are respectively formed on both side fringes in the sheet short side direction in the third component sheet 53. In addition, the minimum width (minimum length) W1 of each of the first and second cutout parts 65 and 67 in the sheet short side direction SD is set longer than the length W2 from the side fringe of the third component sheet 53 in the sheet short side direction SD to the inner side fringe of each of the first and second coating parts 59 and 61. The length T1 of each of the first and second cutout parts 65 and 67 in the envelope unfolding direction ED is set shorter than the length T2 from the other end in the envelope unfolding direction ED in the third component sheet 53 to the another coating part 63 in the envelope unfolding direction ED. Here, although the first and second cutout parts 65 and 67 of the third component sheet 53 are line-symmetric with respect to the centerline (sheet centerline) L in the sheet short side direction SD, they may be asymmetric with respect to the centerline L in the sheet short side direction SD.

On the tips of both side fringes in the sheet short side direction SD in the first component sheet 47, a first and a second chamfer 69 and 71 are formed, respectively. The width (length) W3 of each of the first and second chamfers 69 and 71 in the sheet short side direction SD is set longer than the length W4 (=W2) from the side fringe of the envelope sheet P1 in the sheet short side direction SD to the inner side fringe of each of the first and second coating parts 59 and 61.

Subsequently, the operation and effect of the first embodiment of the present invention will be described.

Since the another coating part 63 is formed along the sheet short side direction SD, on a region which is a part of the envelope outer side of the third component sheet 53 and which contacts the flap 57 by folding along the second folding line 55, the another coating part 63 of the third component sheet 53 can be sufficiently spaced apart from the end of the envelope sheet P1 in the envelope unfolding direction ED so that an absorption area can be sufficiently secured around the another coating part 63 of the third component sheet 53. In addition, since the first and second cutout parts 65 and 67 extending in the extension direction of the first and second coating parts 59 and 61 are respectively formed on both side fringes in the sheet short side direction SD in the third component sheet 53, the rigidity of the third component sheet 53 can be reduced. Accordingly, even if deformation occurs around the another coating part 63 of the third component sheet 53 due to coating of water paste as shown in FIG. 5, the deformation around the another coating part 63 of the third component sheet 53 can be easily corrected by absorbing the envelope sheet P1 toward the endless belt 13 when performing printing on the envelope sheet P1 by the printer 9. In addition, since the first and second chamfers 69 and 71 are respectively formed at the tips of both side fringes in the sheet short side direction SD in the first component sheet 47, warping deformation caused by coating of pressure-sensitive adhesive near the tips of both side fringes in the sheet short side direction SD in the first component sheet 47 can be reduced. Therefore, stable passage of the envelope sheet P1 can be performed between inkjet heads 11A, 11B, 11C and 11D, and the endless belt 13, whereby occurrence of paper jam can be sufficiently suppressed.

Figure 4:
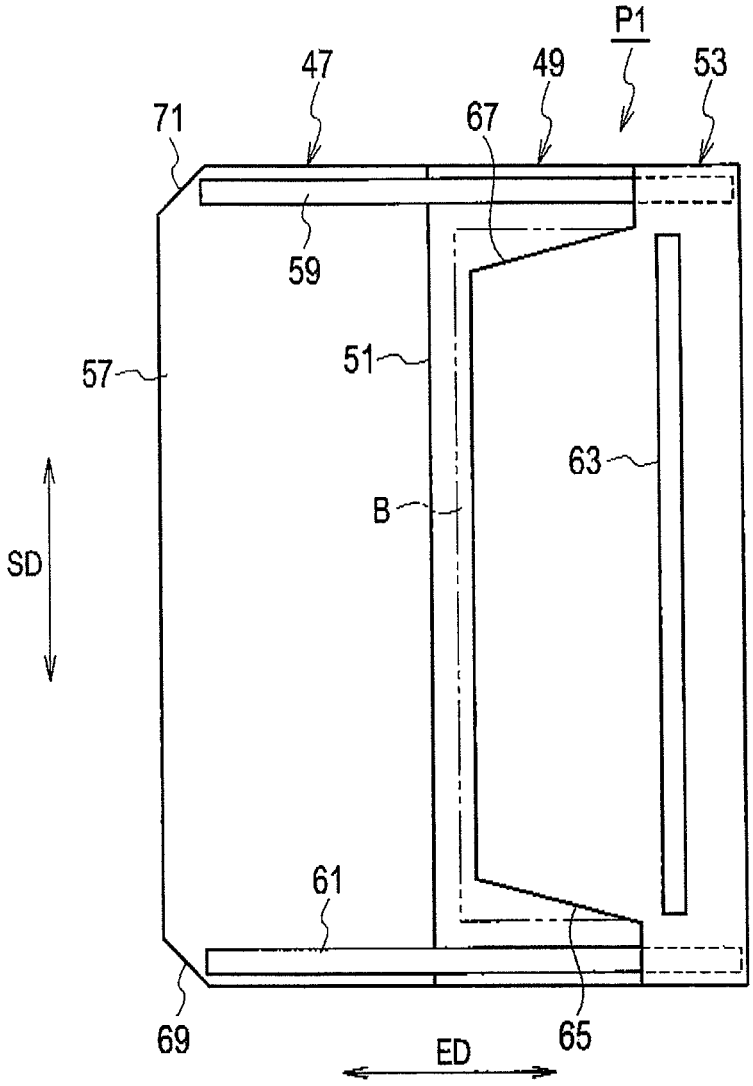
FIG. 4 is an explanatory view of an operation of the envelope according to the first embodiment of the present invention.

Since the minimum width W1 of each of the first and second cutout parts 65 and 67 in the sheet short side direction SD is set longer than the length W2 from the side fringe of the envelope sheet P1 in the sheet short side direction SD to the inner side fringe of each of the first and second coating parts 59 and 61, a degree of sealing of the envelope M can be sufficiently secured by bonding, via the first and second cutout parts 65 and 67 of the third component sheet 53, the first and second coating parts 59 and 61 of the envelope inner side of the first component sheet 47 to the first and second coating parts 59 and 61 of the second component sheet, in a state where the first and second coating parts 59 and 61 of the envelope inner side of the second component sheet 49 are bonded to the first and second coating parts 59 and 61 of the envelope inner side of the third component sheet 53 as shown in FIG. 4. In other words, a degree of sealing of the envelope M can, be sufficiently secured by simply forming the first and second coating parts 59 and 61 on the envelope inner side of the first component sheet 47 to the third component sheet 53, without forming a coating part where pressure-sensitive adhesive is pasted, on the envelope outer side of any of the component sheets (e.g., the third component sheet 53). Therefore, the number of manufacturing processes of the envelope sheet P1 can be reduced so as to reduce the manufacturing cost of the envelope sheet P1. In addition, bonding of envelope sheets P1 can be prevented by simply overlaying a large number of envelope sheets P1 so that either the inner or the outer side of the envelope faces upward, thereby increasing the ease of handling of envelope sheets P1.

Particularly, if the first and second cutout parts 65 and 67 of the third component sheet 53 are asymmetric with respect to the centerline L in the sheet short side direction SD, it is easy to extract, from among a large number of envelope sheets P1, those having reversed orientation of the inner and the outer sides, by simply overlaying the large number of envelope sheets P1. Accordingly, ease of handling of the envelope sheets P1 can be further increased.

(Second Embodiment)

An envelope sheet according to the second embodiment of the present invention will be described, referring to FIGS. 7, 8A, 8B and 8C.

Figure 1:
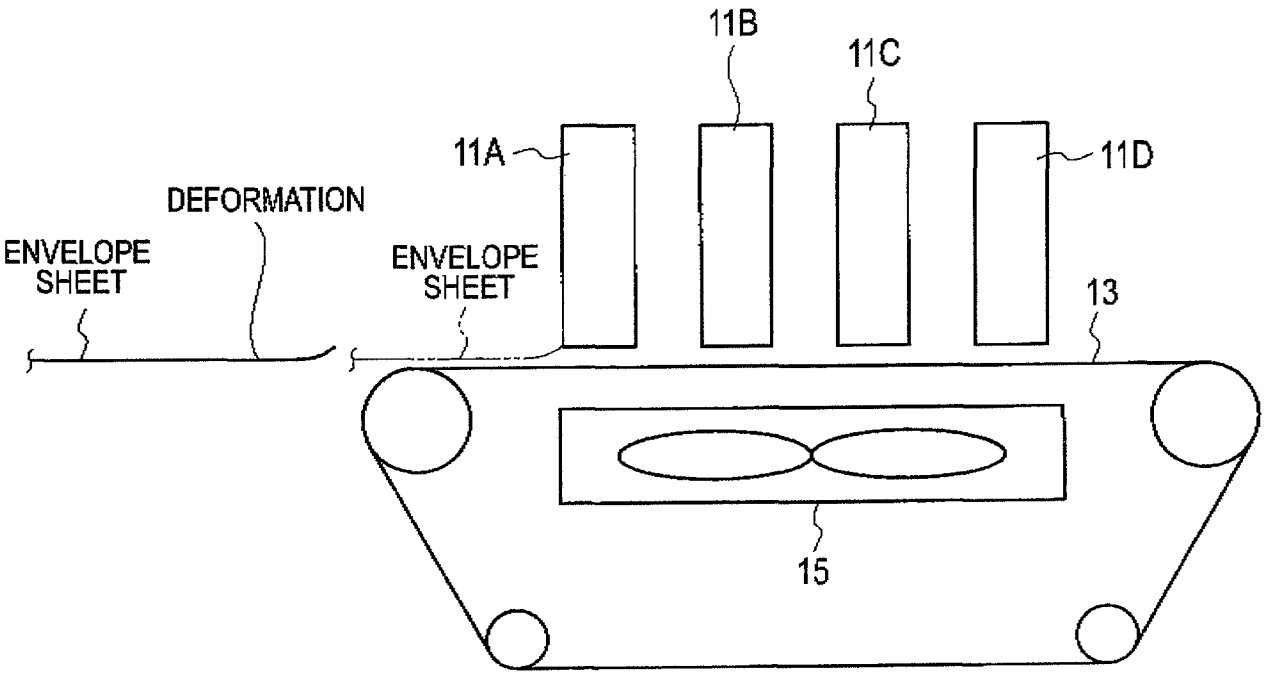
FIG. 1 is a schematic diagram showing a printer in a line head inkjet printing device.
Figure 2:
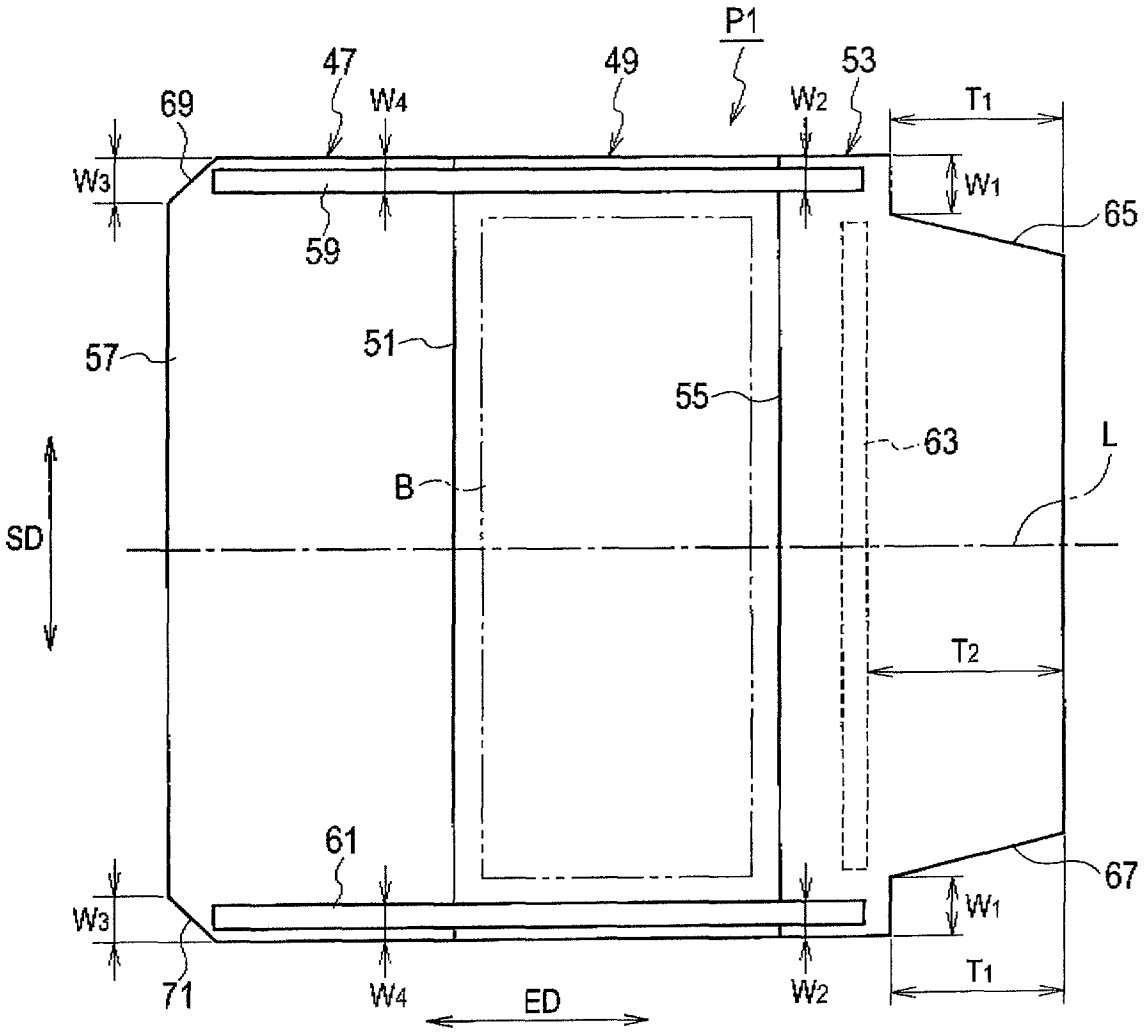
FIG. 2 is a view of an envelope sheet according to the first embodiment of the present invention seen from the envelope inner side.
Figure 3A:
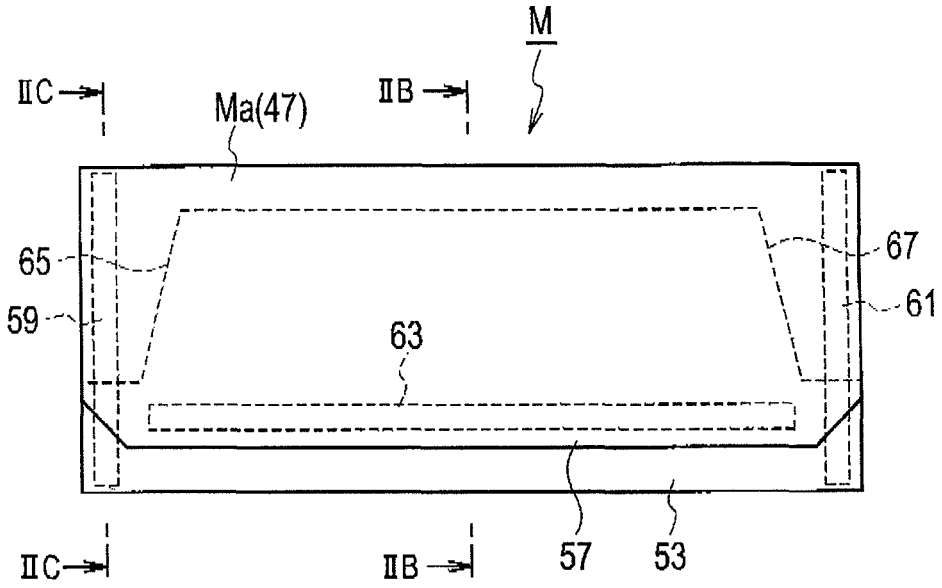
FIG. 3A is a view of the envelope according to the first embodiment of the present invention seen from the back sheet side.
Figure 3B:
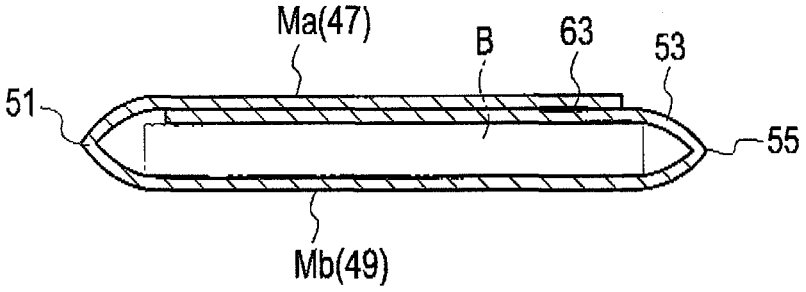
FIG. 3B is a cross-sectional view taken along line IIB to IIB in FIG. 3A.
Figure 3C:
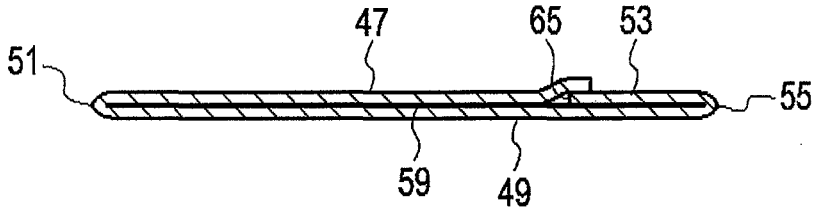
FIG. 3C is a cross-sectional view taken along line IIC-IIC in FIG. 3A.

As shown in FIGS. 7 and 8A to 8C, an envelope sheet P1A is used when manufacturing an envelope with the content B enclosed therein by the automatic envelope manufacturing system 1 described above (see FIG. 5). The envelope sheet P1A has a configuration similar to that of the envelope sheet P1 according to the first embodiment of the present invention (see FIG. 1) except for the following points. Note that, for the plurality of components in the envelope sheet P1A, those corresponding to the components in the envelope sheet P1 are provided with identical reference numerals.

The envelope sheet P1A according to the second embodiment of the present invention has, in addition to the first component sheet 47, the second component sheet 49, and the third component sheet 53, a fourth rectangular component sheet 75 consecutively connected to the third component sheet 53 along the envelope unfolding direction ED via the third folding line 73. In other words, the four component sheets 47, 49, 53 and 75 are consecutively connected along the envelope unfolding direction ED via the three folding lines 51, 55 and 73. Here, the fourth component sheet 75 holds the content B in cooperation with the second component sheet 49 so as to sandwich it therebetween, similarly to the third component sheet 53. The length of the fourth component sheet 75 in the envelope unfolding direction ED is set not more than the length of the third component sheet 53 in the envelope unfolding direction ED. In addition, the length (width) W5 of the fourth component sheet 75 in the sheet short side direction SD is set not more than the length W6 (same as the length of the third folding line 73 in the sheet short side direction SD, in the second embodiment of the present invention) of the third folding line 73 in the sheet short side direction SD. When folding the envelope sheet P1A, the fourth component sheet 75 is folded back toward the envelope inner side.

The second embodiment of the present invention also exhibits a similar operation and effect to that of the first embodiment of the present invention.

Note that, the present invention is not limited to the embodiments described above, and may be implemented in various aspects by making appropriate modifications. In addition, the scope of right included in the present invention is not limited to the embodiments described above.

What is claimed is:

1. An envelope sheet used when manufacturing an envelope, comprising:

n (where n is an integer of three or more) rectangular component sheets adjacently aligned in an envelope unfolding direction; and (n−1) folding lines for consecutively connecting the n component sheets along the envelope unfolding direction, wherein each folding line consecutively connects adjacent component sheets and extends in an orthogonal direction that is orthogonal to the envelope unfolding direction, wherein a first component sheet serves as a front sheet or a back sheet of the envelope, a second component sheet serves as a back sheet or a front sheet of the envelope, the first component sheet has an openable and closable flap on one end side extending in the envelope unfolding direction, a first coating part and a second coating part coated with pressure-sensitive adhesive are provided on an envelope inner side and respectively extend along the envelope unfolding direction on fringes of the first component sheet, the second component sheet, and a third component sheet, and another coating part coated with another adhesive provided on an envelope outer side of the third component sheet for closing the flap, the another coating part extends along the orthogonal direction and contacts the flap but not an adhesive when the envelope sheet is folded along the second folding line, wherein a first cutout part and a second cutout part extend in the envelope unfolding direction, and are respectively provided on fringes of the third component sheet, the first coating part and the second coating part on the third component sheet are bonded to a part of the first coating part and a part of the second coating part on the second component sheet when the envelope sheet is folded along the second folding line, and the first coating part and the second coating part on the first component sheet are bonded to a remaining part of the first coating part and a remaining part of the second coating part on the second component sheet via the first cutout part and the second cutout part on the third component sheet when the envelope sheet is folded along the first folding line.

2. The envelope sheet according to claim 1, wherein a minimum width of each of the first cutout part and the second cutout part in the orthogonal direction is set longer than a length from a side fringe of the third component sheet in the orthogonal direction to an inner side edge of each of the first coating part and the second coating part.

3. The envelope sheet according to claim 2, wherein the first cutout part and the second cutout part of the third component sheet are asymmetric with respect to a centerline in the orthogonal direction.

4. The envelope sheet according to claim 1, wherein a first chamfer and a second chamfer are respectively provided on tips of both side fringes in the orthogonal direction in the first component sheet.

5. An envelope sheet used when manufacturing an envelope, comprising:

n (where n is an integer of three or more) rectangular component sheets adjacently aligned in an envelope unfolding direction; and (n−1) folding lines for consecutively connecting the n component sheets along the envelope unfolding direction, wherein each folding line consecutively connects adjacent component sheets and extends in an orthogonal direction that is orthogonal to the envelope unfolding direction, wherein a first component sheet serves as a front sheet or a back sheet of the envelope, a second component sheet serves as a back sheet or a front sheet of the envelope, the first component sheet has an openable and closable flap on one end side extending in the envelope unfolding direction, a first coating part and a second coating part coated with pressure-sensitive adhesive are provided on an envelope inner side and respectively extend along the envelope unfolding direction on fringes of the first component sheet, the second component sheet, and a third component sheet, and another coating part coated with another adhesive provided on an envelope outer side of the third component sheet for closing the flap, the another coating part extends along the orthogonal direction and contacts the flap but not an adhesive when the envelope sheet is folded along the second folding line, wherein a first cutout part and a second cutout part extend in the envelope unfolding direction, and are respectively provided on fringes of the third component sheet, and a minimum width of each of a portion of the first cutout part and the second cutout part extending in the orthogonal direction is set longer than a length from each of the fringes of the third component sheet to each edge of the first coating part and the second coating part in the orthogonal direction.

6. The envelope sheet according to claim 1, wherein the another adhesive is a water paste.

7. An envelope used when manufacturing an envelope, comprising:

n (where n is an integer of three or more) rectangular component sheets adjacently aligned in an envelope unfolding direction; and (n−1) folding lines for consecutively connecting the n component sheets along the envelope unfolding direction, wherein each folding line consecutively connects adjacent component sheets and extends in an orthogonal direction that is orthogonal to the envelope unfolding direction, wherein a first component sheet serves as a front sheet or a back sheet of the envelope, a second component sheet serves as a back sheet or a front sheet of the envelope, the first component sheet has an openable and closable flap on one end side extending in the envelope unfolding direction, a first coating part and a second coating part coated with pressure-sensitive adhesive are provided on an envelope inner side and respectively extend along the envelope unfolding direction on fringes of the first component sheet, the second component sheet, and a third component sheet, and another coating part coated with another adhesive is provided on an envelope outer side of the third component sheet for closing the flap, the another coating part extends along the orthogonal direction and contacts the flap but not an adhesive when the third component sheet is folded along a folding line, and wherein a first cutout part and a second cutout part extend in the envelope unfolding direction, and are respectively provided on fringes of the third component sheet.

* * * * *